United States Patent [19]

Heemstra

[11] 4,132,182

[45] Jan. 2, 1979

[54] TUFTING MACHINE

[76] Inventor: Theodore C. Heemstra, 958 Hollywood St. NE., Grand Rapids, Mich. 49505

[21] Appl. No.: 822,821

[22] Filed: Aug. 8, 1977

[51] Int. Cl.[2] ..... D05C 15/00; D05C 15/06

[52] U.S. Cl. ..... 112/79 R; 112/80

[58] Field of Search ..... 112/80, 169; 223/104

[56] References Cited

U.S. PATENT DOCUMENTS

| | | | |
|---|---|---|---|
| 1,958,556 | 5/1934 | White | 112/80 |
| 2,057,920 | 10/1936 | Rose | 112/80 |
| 2,078,258 | 4/1937 | Lundgren | 112/80 |
| 3,142,270 | 7/1964 | Schauer | 112/80 |

FOREIGN PATENT DOCUMENTS

| | | | |
|---|---|---|---|
| 853635 | 3/1940 | France | 112/80 |
| 7107 | 10/1907 | United Kingdom | 112/80 |

*Primary Examiner*—Ronald Feldbaum

*Attorney, Agent, or Firm*—Price, Heneveld, Huizenga & Cooper

[57] ABSTRACT

A tufting machine for forming loop or cut pile tufts in a backing material from at least one continuous strand of yarn. A hollow channel-like needle having a yarn entrance opening is reciprocally inserted through the backing material after which a plunger having a rounded end pushes a length of yarn through the opening in the backing while pulling yarn through the needle and needle opening. A cutting blade, slidingly supported between the needle and plunger, is then reciprocated outwardly to cut the formed loop. The machine may be adjusted to leave the formed loops uncut and/or to change the height of the loop or cut pile tufts. The needle, cutting blade and plunger are rigidly mounted on slide bars slidably mounted on the exterior of a rigid, rectangular cross-section, support arm and are reciprocally driven in timed relationship by an electric motor and pivot crank arrangement. The yarn is positively clamped and held on both sides of the needle during loop formation and cutting by yarn-holding mechanisms to form loops and cut pile of precise, even height across the backing.

42 Claims, 29 Drawing Figures

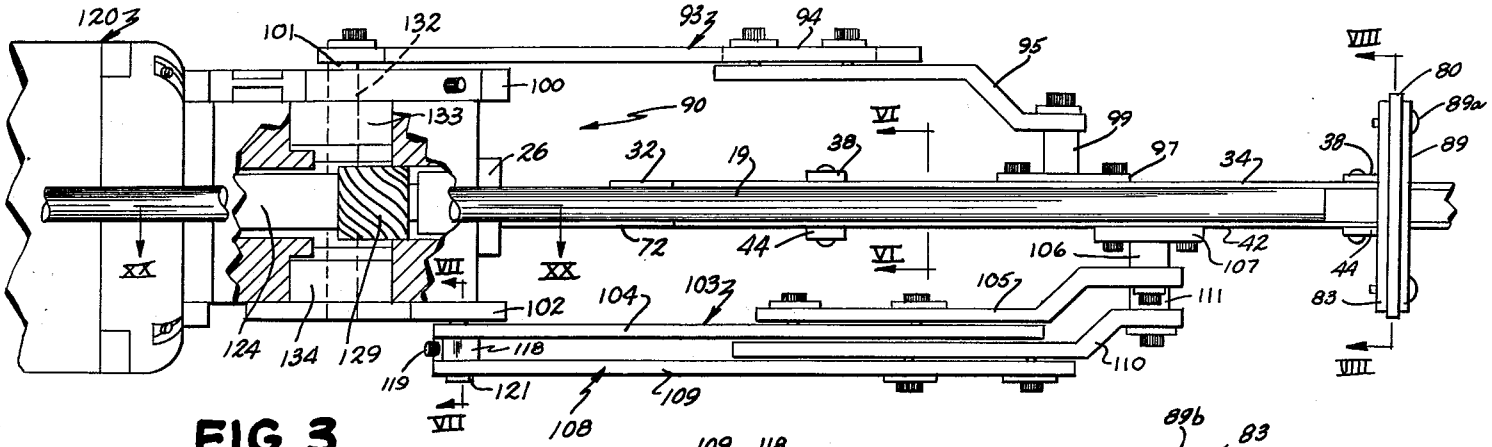
FIG. 3.
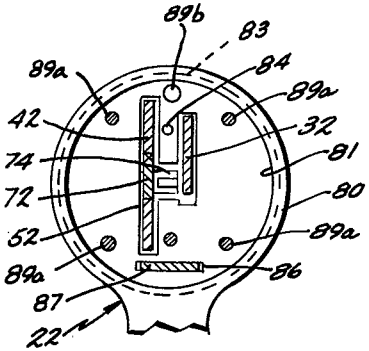
FIG. 8.
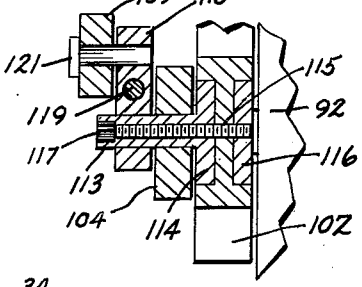
FIG. 7.
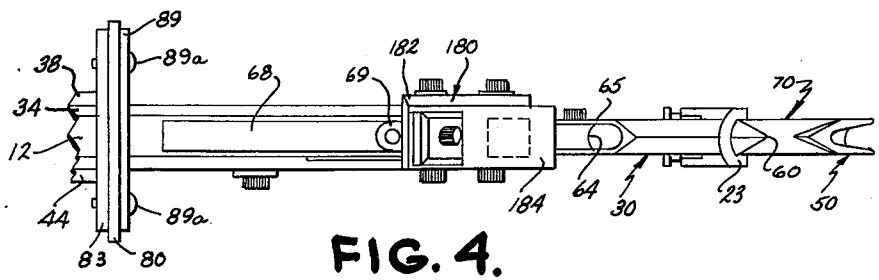
FIG. 4.
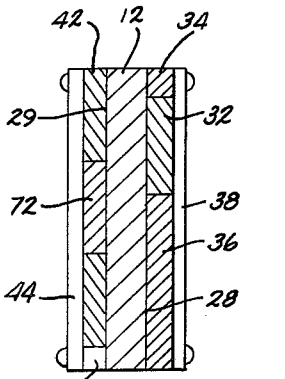
FIG. 6.
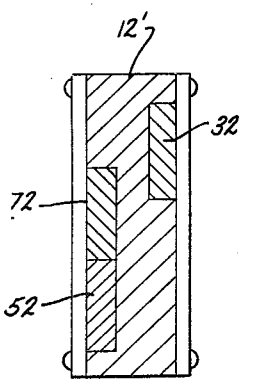
FIG. 6.A.

TUFTING MACHINE

BACKGROUND OF THE INVENTION

This invention relates to apparatus for forming tufts of yarn through woven fabric or other backings to form carpets, wall hangings or the like, and more particularly, to a tufting machine for forming loop or cut pile tufts in a backing material from at least one continuous strand of yarn.

Numerous tufting machines, including both hand-operated and motor driven types, have been devised and used in the past. Some prior machies have utilizes a single needle for making an opening through a backing material on which the rug is being formed and simultaneously inserting yarn through that operating to form a loop. Others have used separate needle and looper mechanisms for forming loops. In addition, certain prior machines have included devices for cutting the formed loop into two strands to form cut pile carpets. In some instances, the cutter has been combined with the loop forming member. An example of a hand-driven apparatus is disclosed in U.S. Pat. No. 2,057,920 and includes a needle, a loop-forming member, and a cutting member, all of which are reciprocated by hand. Examples of prior motor-driven machines are described in U.S. Pat. Nos. 3,142,276 and 3,645,219.

Numerous problems have been encountered with the prior machines. Most, if not all, have been unable to rapidly and consistently provide loops of the same height above the backing material and/or precisely cut the formed loops in an even pile. The pile of the rugs formed by the prior machines has, therefore, been uneven, necessitating time-consuming shearing to obtain the desired even surface. Although certain machines have attempted to hold the yarn during loop formation, an uneven pile has still resulted.

Many of the prior motor-driven machines have suffered from excessive weight and extreme complexity necessitating frequent repair and considerable down time. Certain prior powered machines included tubular supports receiving therewithin reciprocating members supporting the needle and loop-forming members. These reciprocating members were driven by cranks having connections extending through slots in the tubular supports. Such arrangements, which substantially enclose the reciprocating mechanisms, were subject to frequent breakdown and high wear along the tube slots. Maintenance of the tubular supports was extremely difficult because access to the enclosed elements was virtually impossible without disassembly of much of the machine. In addition, prior powered machines were subject to high vibration, were awkward to handle, and thus, were difficult for many operators to use. Because the machines are used to form decorative designs necessitating frequent, sharp and intricate turns during the tufting operation, the weight, vibration and awkwardness of the prior machines make them undesirable.

Other problems included the inability to maintain the sharpness of the cutting element requiring disassembly of the machine merely to sharpen that element. Also, adjustment to change from cut pile to loop or the size of either was difficult with prior machines. Further, many of the machines had difficulty in consistently pushing and extending yarn through the backing material.

Therefore, a need was apparent for an improved tufting machine which could provide cut or looped pile of a consistently even height, be light, quiet and easy to operate, have high durability, low wear, and be subject to easy maintenance when required.

SUMMARY OF THE INVENTION

Accordingly, the present invention provides a tufting machine which overcomes the above problems and provides either cut or looped pile tufts from at least one continuous strand of yarn in a consistently even manner. In one aspect, the invention includes an elongated, rigid support arm having forming means at one end thereof for forming successive loop or cut pile tufts from a continuous length of yarn in a backing material. The forming means include a neeedle for insertion through the backing, a plunger for pushing at least one loop of yarn through the backing a predetermined distance beyond the backing at the point of insertion of the needle, and a cutting blade for cutting the loop of yarn when desired. The needle is channel-like and hollow and open on one side receiving the cutting blade and plunger longitudinally and slidably therewithin with the cutting blade being intermediate the plunger and the closed side of the needle. Slide means are mounted on the exterior of the support arm for individually and separately reciprocating the needle, cutting blade and plunger while drive means are provided for reciprocally moving the slide means in timed relationship to one another.

In other aspects of the invention, yarn-holding means are provided on both sides of the needle, cutting blade, plunger combination. A first yarn-holding means is provided for positively holding the yarn at one side of the needle during formation of the loops by the plunger. A second yarn-holding means is provided for clamping and holding the yarn on the opposite side of the needle during any cutting of the formed loops by the cutting blade. The two yarn-holding means provide the ability to precisely form even loop or cut pile tufts throughout the entire carpet being made.

In yet other aspects, the support for the slide mechanisms which reciprocate the needle, cutting blade and plunger is rectangular and solid and includes the slide mechanisms on its exterior for low wear, easy access and maintenance. In addition, means are provided for allowing the needle to move slightly transverse to its major direction of reciprocation to facilitate advancement of the machine across the woven backing.

The present invention provides significant advantages over the prior known structures. The needle, cutting blade and plunger are arranged in a nested, supporting and sliding arrangement and each is rigidly secured to a reciprocating slide to provide long wear, light weight and easy maintenance. The plunger rolls yarn over its rounded end and easily forms precise, consistently sized loops through openings provided by the needle while drawing yarn through the needle. At the greatest extension of the plunger, and during any cutting of the formed loop, the yarn-hold mechanisms are actuated on each side of the needle to positively hold the yarn and prevent further extension enabling consistently and evenly formed loops and/or cut pile tufts. The device may be easily adjusted to form cut pile or looped tufts and also to change the height of the pile being formed without modifying the timing of the needle, cutting blade and plunger or major disassembly of the machine. The device is approximately 15 percent faster than prior known machines, is precisely balanced and smooth in operation and saves nearly all shearing or carving time which was previously necessary to smooth out the pile formed by prior known machines. In addition, the machine is easily advanced along the woven backing, may be easily turned to form intricate patterns in the carpets, and may include a self-sharpening blade. When sharpening of the blade is necessary, the blade may be easily removed without further disassembly of the machine.

These and other objects, advantages, purposes and features of the invention will become more apparent from a study of the following description taken in conjunction with the drawings.

BRIEF DESCRIPTION OF THE DRAWINGS

FIG. 3 is a fragmentary, plan view of a portion of the tufting machine shown in FIGS. 1 and 2 with a portion of the gear box broken away to illustrate the spiral gears therein;

FIG. 4 is a fragmentary, plan view of the material-engaging portion of the tufting machine shown in FIGS. 1 and 2;

FIG. 6 is a sectional view of the support arm of the tufting machine taken along plane VI—VI of FIG. 3;

FIG. 6A is a sectional view of an alternate support arm for the tufting machine of the present invention;

FIG. 7 is a fragmentary, sectional view of the pivot shaft and crank arm connection to one side of the gear box taken along plane VII—VII of FIG. 3;

FIG. 8 is a fragmentary, sectional view of the swivel handle and support therefor taken along plane VIII—VIII of FIG. 3;

DESCRIPTION OF THE PREFERRED EMBODIMENT

Figure 1:
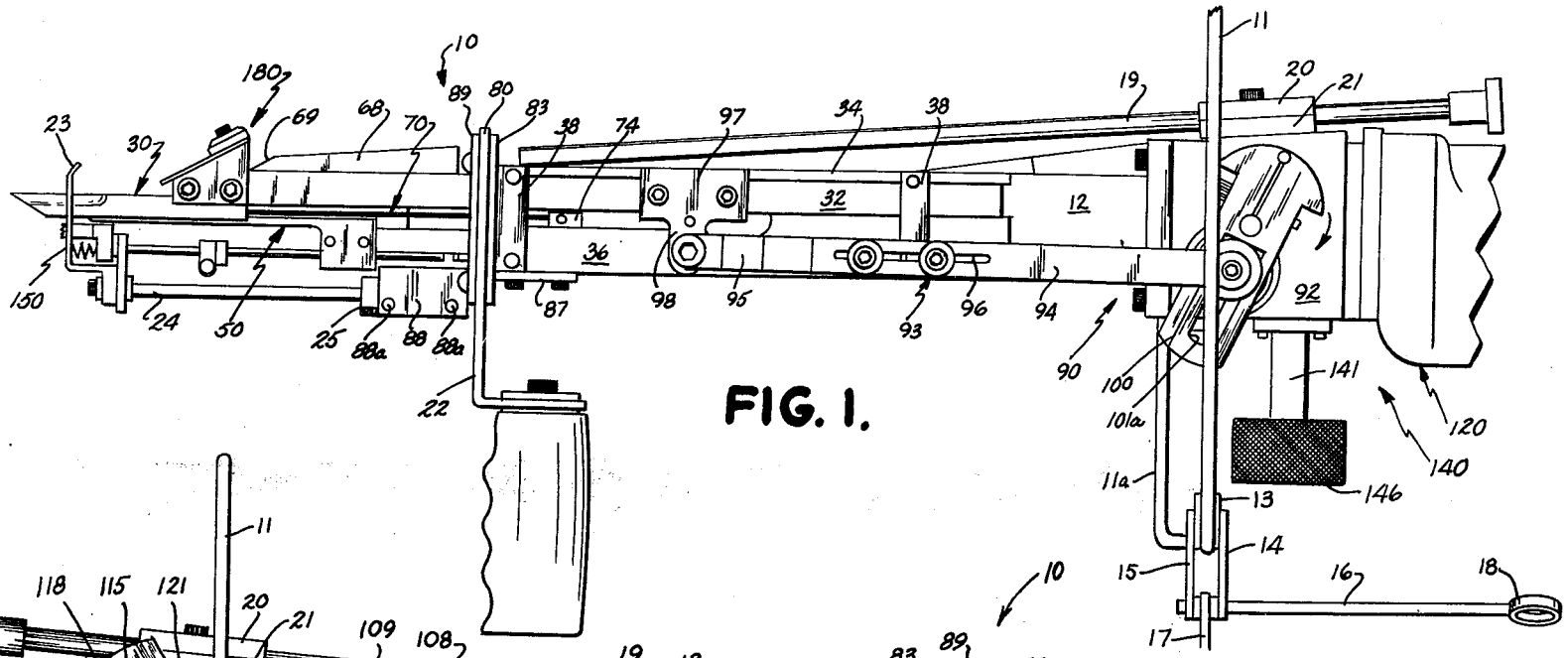
FIG. 1 is a fragmentary, side elevation of the tufting machine of the present invention.

Referring now to the drawings in greater detail, FIGS. 1-5 illustrate the assembled, hand-held, power-driven tufting machine 10 of the present invention. The machine includes an elongated, solid, rigid support arm 12 including a plurality of elongated, rigid slide bars 32, 52, 72 slidably mounted thereon and supporting a needle 30, a plunger 50, and a cutting blade 70 rigidly secured to the individual slide bars. The slide bars with the needle, plunger and cutting blades attached thereto are reciprocally driven by a drive and pivot crank assembly 90 powered by a conventional, variable speed drill motor 120. During formation of the successive loops from the continuous strand or strands of yarn by means of the needle, plunger and cutting blade, the yarn at the base of the loop previously formed is held by a positively actuated yarn-gripping assembly 150 on one side of the needle, while the yarn on the other side of the needle is clamped and held by a yarn latch assembly 180 during cutting of the formed loop.

Machine 10 is adapted to be suspended from an overhead support by means of a support ring 11 welded to a downwardly extending ring-support arm 11*a* having a flange bolted to the bottom of gear box 92 in drive and pivot crank assembly 90. A support roller 13 (FIGS. 1, 2 and 5) is pivotally secured between support links 14, 15 which are secured at their opposite ends by an elongated pin 16. Pin 16 supports an eyelet or hook 17. Roller 13 is movably mounted on the support ring 11 to enable the machine to be rotated about the center axis of the support ring when suspended. Pin 16 includes a yarn guide eyelet 18 on its outer end which guides the yarn from an overhead spool or rack into yarn-guide tube 19 on the top of the machine. Tube 19 is inclined toward the operative loop-forming mechanism at the front of the machine and is secured to the top of gear box 92 by bolted, opposing, clamp blocks 20, 21 (FIGS. 1, 2, 5 and 20). A swivel handle 22 is rotatably mounted coaxially with support ring 11 such that the machine operator may grasp handle 22 with one hand and the handle from the drill motor 120 with the other hand while the machine is generally suspended from the support ring. A support foot 23, bolted to the underside of the forward end of support arm 12 by means of a support rod 24, provides support for the machine against the fabric, woven or other backing material in which the loop or cut pile tufts are to be formed.

Generally, the tufting machine 10 is designed for use by an operator standing adjacent a vertically oriented sheet of backing material which is preferably woven and stretched vertically on a frame such that it is taut. The generally horizontally supported machine may then be run along the vertical plane of the material and rotated about the common axis of support ring 11 and handle 22 while being guided by that handle and the handle of drill motor 120.

Figure 2:
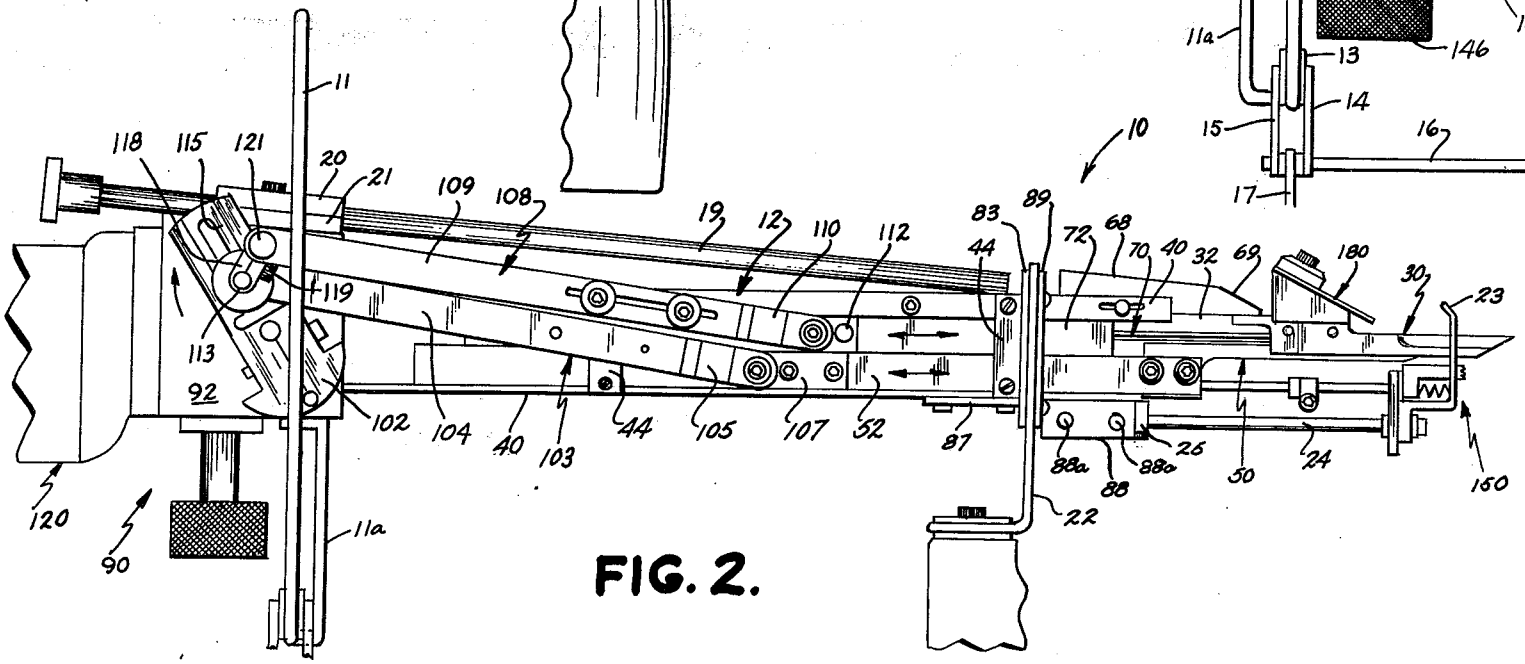
FIG. 2 is a fragmentary, side elevation of the tufting machine shown in FIG. 1 taken from the side opposite that of FIG. 1.
Figure 20:
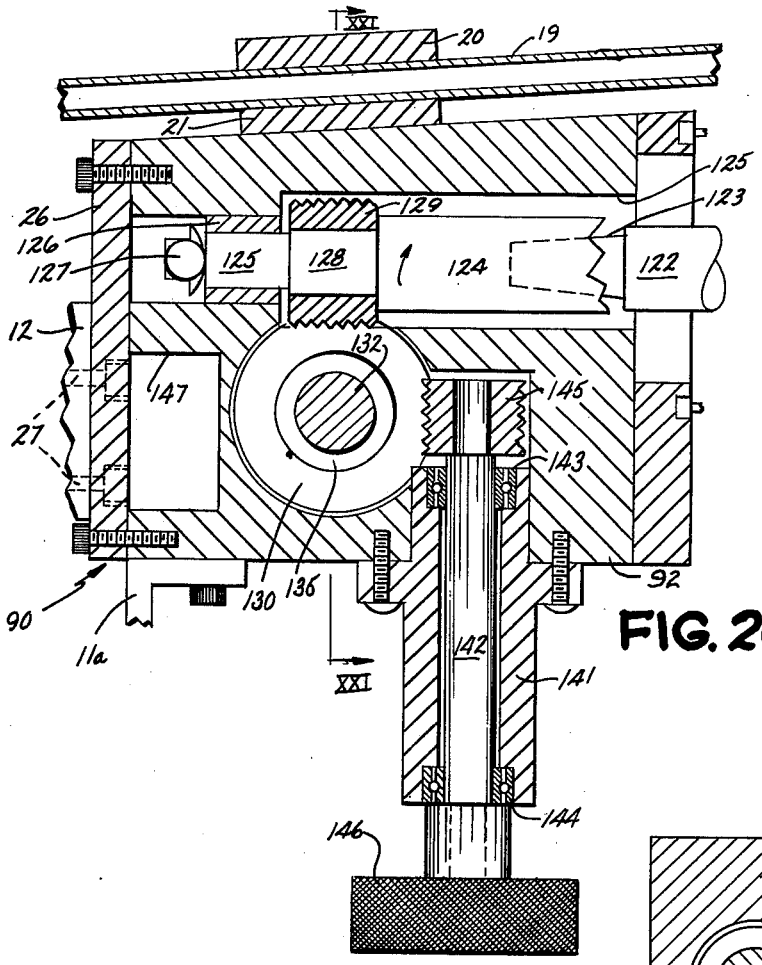
FIG. 20 is a fragmentary, sectional side elevation of the gear box and drive asembly of the present tufting machine taken along plane XX—XX of FIG. 3.
Figure 24:
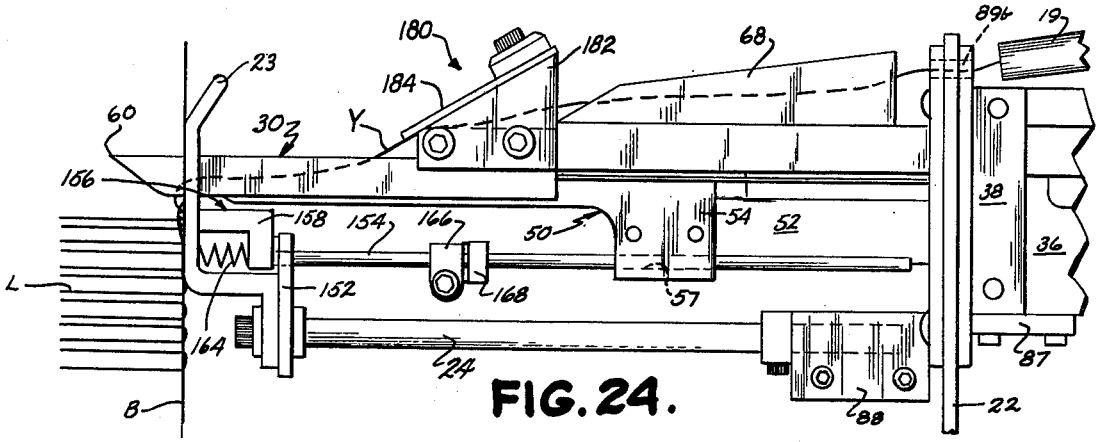
FIG. 24 is a fragmentary, side elevation of the material engaging end of the tufting machine illustrating insertion of the needle through the backing material at the beginning of the loop-forming cycle of the machine.
Figure 25:
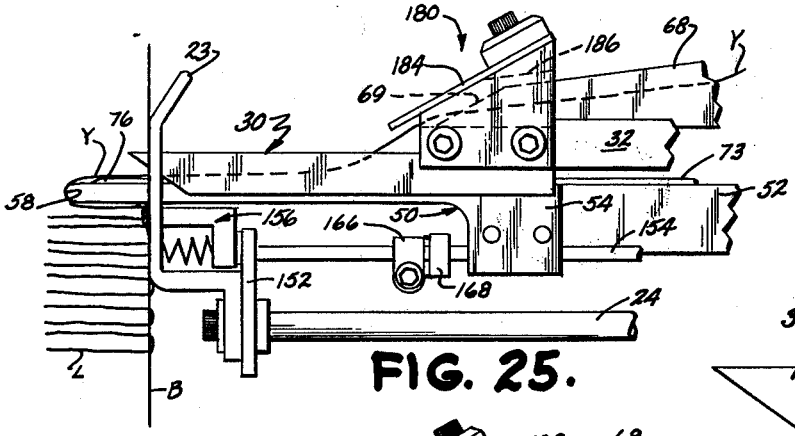
FIG. 25 is a fragmentary, side elevation similar to FIG. 24 but showing a second stage in the loop-forming cycle with the plunger partially inserted through the opening in the backing material.

As is best seen in FIGS. 1–3, 5 and 6, the rigid support arm 12 has a rectangular cross-section when viewed transversely to its elongated direction. Its rear end surface is bolted to the front surface of a support block 26 by means of bolts 28 (FIG. 20). Support block 26 is in turn bolted to the front surface of gear box 92 (FIG. 24). Three elongated, rigid, solid, slide bars 32, 52 and 72 are slidingly mounted in engagement with opposite side surfaces of support arm 12 as shown in FIGS. 1, 2 and 6. Slide bar 32, on which needle 30 is secured at its outer end, slidably engages surface 28 of support arm 12 and is slidingly confined and supported by guide bars 34, 36 and a pair of spaced, retaining straps 38 bolted through guide bars 34, 36 to bar 12. Slide bars 52 and 72, to which plunger 50 and cutting blade 70 are respectively secured at the needle ends thereof, are slidably supported against the opposite side 29 of bar 12 by means of guide bars 40, 42 which are retained in place by spaced, retaining straps 44 bolted through bars 40, 42 to bar 12. Support arm 12 is preferably formed from aluminum to reduce the weight of the machine while slide bars 32, 52 and 72, guide bars 34, 36, 40 and 42, and retaining straps 38, 44 are all formed from oil-hardened tool steel to reduce wear.

Alternately, slide bars 32, 52 and 72 may be received in corresponding rectangular recesses formed in the side surfaces of a thicker support arm 12′ as shown in FIG. 6A. Alternate support arm 12′ is otherwise similar to and secured to the machine in the same fashion as arm 12 and eliminates the need for separate guide bars 34, 36 40 and 42.

Figure 5:
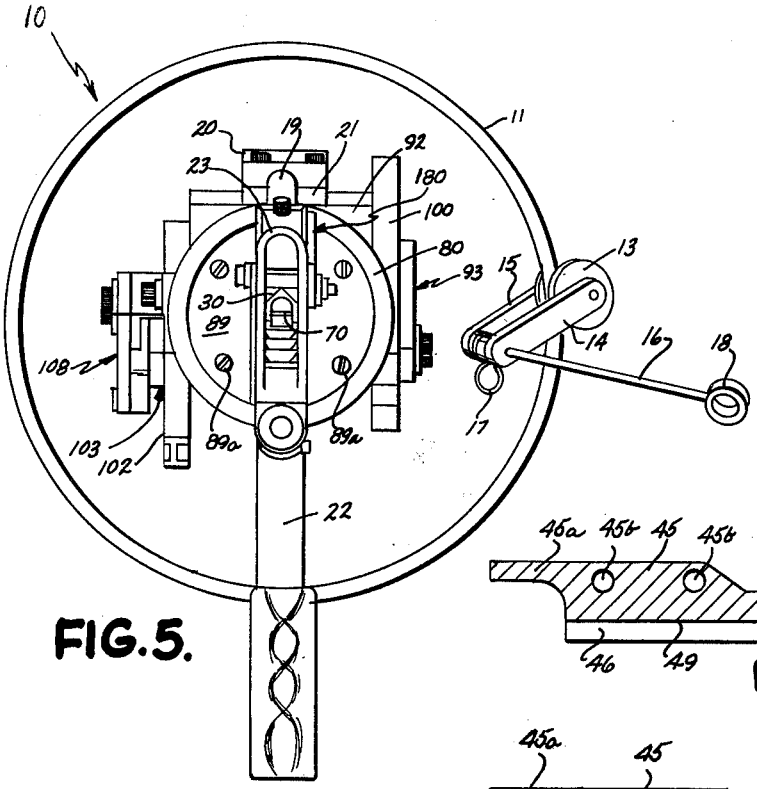
FIG. 5 is an end elevation of the tufting machine shown in FIGS. 1-4 taken from the material-engaging end of the machine.
Figure 11:
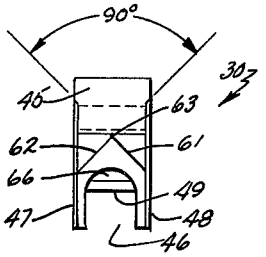
FIG. 11 is an end elevation of the needle shown in FIGS. 9 and 10.
Figure 9:
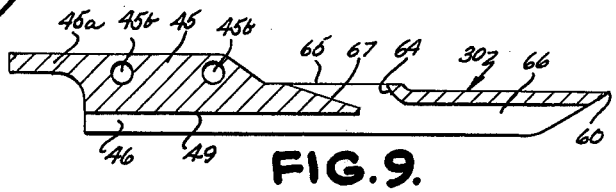
FIG. 9 is a sectional view of a needle for the tufting machine of the present invention.
Figure 10:
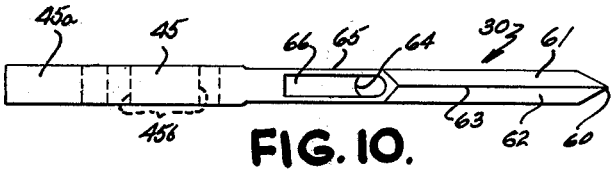
FIG. 10 is a plan view of the needle shown in FIG. 9.

Needle 30 is bolted to the inside surface of slide bar 32 at its outer end by means of an upstanding flange 45 projecting from the generally closed side of needle 30 (see FIGS. 9–11). The open side 46 of needle 30 extends in the opposite direction from flange 45. Bolted to the inside surface of the outer end of slide bar 52 is plunger 50 by means of the downwardly extending flange 54 on plunger 50. Rectangular plunger shaft 56 (FIGS. 15–17) extends outwardly and is received within the open channel formed by sides 47, 48 of needle 30 (see FIGS. 1, 2 and 18). Cutting blade 70 is rigidly secured and bolted to the outer end and inner surface of slide bar 72 by means of rectangular securing block 74 (see FIGS. 1 and 12–14). As is best seen in FIG. 18, elongated blade portion 73 of cutting blade 70 is slidably received between rectilinear guide surface 49 of needle 30 (FIGS. 9 and 11) and the top surface of plunger shaft 56. These surfaces slidingly support and sandwich the cutting blade which is preferably formed from flexible, resilient, spring-type steel. When so secured, needle 30, plunger 50 and cutting blade 70 are all vertically aligned with one another and with the support arm 12 as shown in FIGS. 4 and 5. The nesting of the cutting blade and plunger within the channel-like needle provides effective support for these elements without the necessity of any clamping or spring-biasing force applied externally thereon while the rigid attachment of each of these elements to their respective slide bars provides a durable, long-wearing assembly during operation.

As is best seen in FIGS. 1–4 and 8, swivel handle 22 includes a circular ring 80 integral therewith having a large, central, circular aperture 81 rotatably mounted around a slightly smaller circular central plate 82 and against a circular retaining plate 83. Plates 82 and 83 are bolted to the outer end surface of support arm 12 by bolts 84 and include generally h-shaped cutouts 85 through which slide bars 32, 52, 72 extend along with guide bar 42 (FIG. 8). The central portion of cutout 85 is large enough to allow the reciprocating motion of rectangular securing block 74 of cutting blade 72 to move therethrough as rigidly secured to the inside surface of slide bar 72. In addition, an elongated, generally transverse opening 86 is provided in the lower portion of plate 82 through which an elongated flange 87 of split clamping block 86 is passed for attachment to the underside of support arm 12. Clamping block 88 is vertically split and includes a circular bore receiving the inner end of support rod 24 for foot 23 as shown in FIGS. 1 and 2. Bolts 88*a* between the split portions tightly clamp rod 24 in the bore. A retaining collar 25 is telescoped over rod 24 and tightened against the rod and the end surface of block 88 to determine the length of insertion of the rod in clamping block 88. A second circular retaining plate 89 is bolted against the outer surface of plate 82 by four screws 89*a* extending through plates 89, 82 and 83 and also includes a cutout allowing passage therethrough of the slide and guide bars. Aligned circular apertures through each of the plates 83, 82 and 89 provide a yarn passage 89*b* through the plates in alignment with the outer end of yarn guide tube 19 (FIG. 8). The diameters of plates 89 and 83 are equivalent and larger than the diameter of plate 82 and the inner diameter of ring 80 on swivel handle 22. Accordingly, handle 22 is pivotally and swivelly mounted about the end of support arm 12.

Referring now to FIGS. 9–11, needle 30 includes a pointed outer end 60 formed by sloping, planar surfaces 61, 62 along the closed side of the needle forming a central ridge 63 therealong. These surfaces are preferably at 90° to one another and angle toward the tip 60 at the front as do the flanges 47, 48 below the tip. A yarn entrance opening 64 is provided through the closed side of the needle and surrounded by raised sides 65 and a sloped guide surface 67 leading to the opening 64. The inner surface of the tip portion of the needle is offset from surface 49 which slidingly supports the cutting blade and plunger at the rear of the needle to provide a yarn-receiving space 66 within the needle as shown in FIGS. 9 and 11. The rear of flange 45 extends outwardly in an extension 45*a* having its top surface flush with that of flange 45 to provide a sliding surface which contacts the underside of a sloped, yarn-guide tube 68 bolted to the outer end and inside surface of guide bar 40 (FIGS. 2 and 4). Parallel apertures 45*b* are provided for bolting the needle to the end of its slide bar 32 as described above. The width of the needle between flanges 47, 48 and the yarn-receiving space 66 within the needle as well as opening 64 are sufficient to handle multiple strands of yarn typically up to four strands at a time. However, wider needles may be substituted to handle larger diameter, coarser yarns. The strands may be of one or more colors to provide the desired decorative effects in the rugs produced. The thickness of the needle between ridge 6 and the bottoms of flanges 47, 48 provides a sufficient opening through which the plunger and cutting blade can be inserted through the backing material in which the tufts are inserted. Further, the sloped flanges 47, 48 leading to the tip 60 facilitate advancement of the machine along the backing by urging the machine with a camming action along the backing as the tip is inserted in a fresh portion of the backing. This movement is facilitated by a transverse motion produced by adjustment of the position of the slide bar 32 and guide bar 36 as will be described more fully hereinafter.

Figure 15:
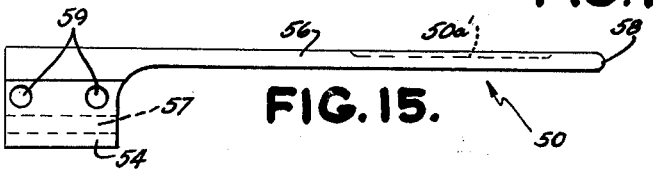
FIG. 15 is a side elevation of a plunger for the tufting machine of the present invention.
Figure 17:
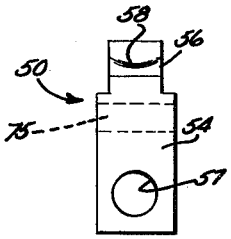
FIG. 17 is an end elevation of the plunger shown in FIGS. 15 and 16.
Figure 16:
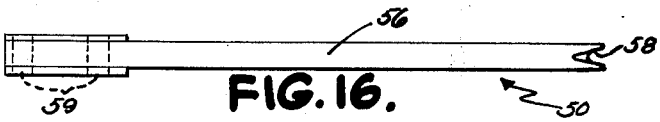
FIG. 16 is a plan view of the plunger shown in FIG. 15.
Figure 18:
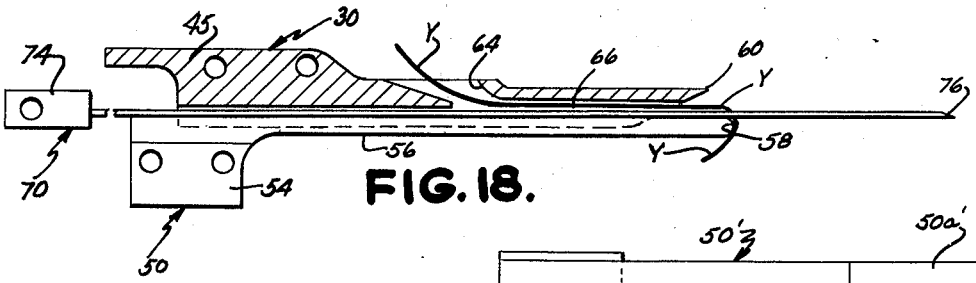
FIG. 18 is a fragmentary, sectional side elevation illustrating the mating, nesting relationship of the needle, cutting blade and plunger when assembled.

As shown in FIGS. 15–17, plunger 50 includes a circular bore 57 extending parallel to shaft 56 through the lower portion of flange 54 for receiving a sliding rod forming a portion of the mechanism for actuating yarn-holding mechanism 150 as described hereinafter. The outer end of shaft 56 is a rounded, contoured, recessed end which allows the yarn to easily roll thereover and therearound without resistance as the plunger pushes the yarn through the opening formed by needle 30 during operation of the machine. Apertures 59 extend parallel to one another and transversely through flange 54 and allow bolting of the plunger to its slide bar 52 as described above. Shaft 56 is narrower than flange 54 to provide proper spacing with the needle, cutting blade and the slide bars.

Figure 12:
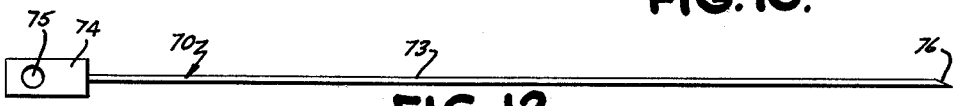
FIG. 12 is a side elevation of a cutting blade for the tufting machine of the present invention.
Figure 13:
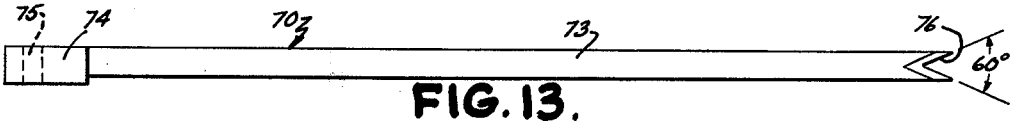
FIG. 13 is a plan view of the cutting blade shown in FIG. 12.
Figure 14:
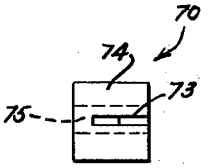
FIG. 14 is an end elevation of the cutting blade shown in FIGS. 12 and 13.

As shown in FIGS. 12–14, cutting blade 70 includes a thin, elongated blade portion 73 secured to the end surface of securing block 74 which includes an aperture 75 therethrough for bolting the blade to the slide bar 72. Blade 73 is slightly offset from the center of block 74 for proper alignment with the needle and plunger. The outer end of cutting blade 73 includes a sharpened, V-shaped, recessed notch 76. The inner edges of the notch are preferably at 60° to one another and are sharpened by beveling the blade from the top surface (FIG. 12). Preferably, the cutting blade 73 is formed from a flexible, resilient, spring-like steel which is sufficiently hard to retain a sharp edge at notch 76. Only a single aperture 75 is required to secure the blade to the slide bar inasmuch as the blade is slidingly sandwiched between plunger 50 and surface 49 of needle 30 which prevents it from oscillating or wobbling with respect to the slide bar.

As shown in FIG. 18 and mentioned above, plunger 50 and cutting blade 70 are nested within the open side of needle 30 with a strand or strands of yarn Y received through opening 64 and passing longitudinally within the needle through space 66 to the end of the plunger. Cutting blade 73 and sharpened end 76 are reciprocated outwardly between the plunger and needle and sever the yarn Y at the time the yarn is held on both sides of the needle by yarn-holding mechanisms 150, 180 as will be described below.

Figure 19:
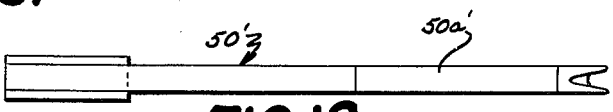
FIG. 19 is a plan view of an alternate plunger including an abrasive sharpening surface for the cutting blade.

In FIG. 19, a modification 50' of plunger 50 is shown including an abrasive, sharpening strip **50*a*' preferably formed from brass or another metal embedded with diamond particles to provide a lapping surface against which the bottom side of cutting blade 73 rubs during each cycle of operation of the machine. Such lapping provides an automatic, self-sharpening action retaining the sharp edge 76 on blade 70. The recessed position of the abrasive surface member 50*a*' is also shown in phantom in FIG. 15. Such self-sharpening facilitates long use of the machine without maintenance although blade 70 may be either sharpened without removal from the machine or easily removed from the machine by removing the bolt from aperture 75 and slide bar 72** without further adjustment or disassembly of the machine.

Referring again to FIGS. 1–3 and 5, each of the slide bars is driven by a connecting arm pivotally secured between the slide bar and one of the rotating cranks 100, 102 on the opposite sides of gear box 92. Cranks 100, 102 are generally T-shaped on one end to counterbalance slotted extensions on their other ends. The T-shaped ends are split and received over the extending ends of gear shaft 132 (FIG. 3). The split ends are bolted together to fix the cranks to the rotatable shaft.

Needle slide bar 32 is reciprocated by a connecting arm 93 including a rectilinear arm portion 94 and an offset portion 95 secured to the outer end of portion 94. Arm portion 94 includes an elongated slot 96 through which a pair of bolts extend to secure portion 95 thereto while allowing adjustment of the position and length of the connecting arm 93 to change the position of the slide bar 32. Connecting arm 93 is pivotally connected to the slide bar 32 by a pivot bracket 97 bolted to the exterior side of slide bar 32 and having a downwardly extending flange 98 from which a pivot post 99 extends outwardly. The apertured end of arm portion 95 is bolted over the reduced diameter portion of post 99 to provide the pivot connection. The opposite end of connecting arm 93 is pivotally secured to crank 100 by a pivot post 101. Post 101 may be slid along an elongated slot **101*a* in one end of rotating crank 100 and clamped in the desired position by a set screw in the end of the pivot post as will be described hereinafter. The amount of reciprocation of the connecting arm 93, and thus the slide bar 32 and needle 30, can be adjusted by the position of the pivot post 101 in the slot 101*a* in the crank 100**.

The cutting blade and plunger slide bars 72 and 52, respectively, are each pivotally connected to a crank 102 on the opposite side of gear box 92 from crank 100 by connecting arms similar to arm 93. Plunger connecting arm 103 includes rectilinear portion 104 and offset portion 105 which are bolted together in a manner similar to arm 93 which allows adjustment of its length. The outer end of arm 103 is pivotally secured to a pivot post 106 extending outwardly from a plate 107 which is bolted to the exterior side of slide bar 52. Similarly, cutting blade connecting arm 108 for slide bar 72 includes a rectilinear portion 109 and an offset portion 110 bolted together from the exterior surface to allow length adjustment like arms 93 and 103. The outer end of arm 110 is pivotally secured to a post 111 which extends from a plate 112 bolted to the exterior surface of slide bar 72.

As is best seen in FIG. 7, both of cutting blade and plunger connecting arms 103, 108 are pivotally secured to a pivot post 113 extending outwardly from a plate 114 received in an elongated recess adjacent an elongated slot 115 in one end of crank 102. A plate 116 received in a similar recess on the opposite side of the crank is threadedly connected to plate 114 by a set screw 117 such that the plates may be clamped together and secured at the desired position along the slot 115 to simultaneously control the amount of reciprocation of both the cutting blade and plunger via slide bars 52, 72. The apertured end of connecting arm portion 104 is slipped over post 113 followed by the apertured end of a split, clamping block 118 clamped around post 113 by set screw 119. The opposite end of clamping block 118 includes an extending stud 121 over which the apertured end of connection arm portion 109 is fitted with a head on a stud 121 retaining that arm thereover. The set screw 119 also clamps stud 121 in fixed position within the clamping block. Accordingly, rotation of crank 102 reciprocates connecting arms 103, 108 and thus slide bars 52, 72, respectively, and plunger 50 and cutting blade 70, respectively. The rotational position of clamping block 118 may be varied by loosening set screw 119 and rotating that clamping block to extend or retract arm 108 with respect to arm 103. This changes the position of the cutting blade with respect to the plunger providing one method of adjustment to change from cut pile loop formation to simple loop formation with the machine.

Alternately, the position of the cutting blade 70 with respect to plunger 50 may be adjusted by changing the position of connecting arm portion 105 with respect to arm portion 104. Further, securing block 74 may be moved along the inside surface of cutting blade slide bar 72 and bolted to a different position. Either of these latter two adjustments changes the position of the cutting blade without affecting the timed relationship between the cutting blade and needle as does the rotation of clamping block 118.

Figure 21:
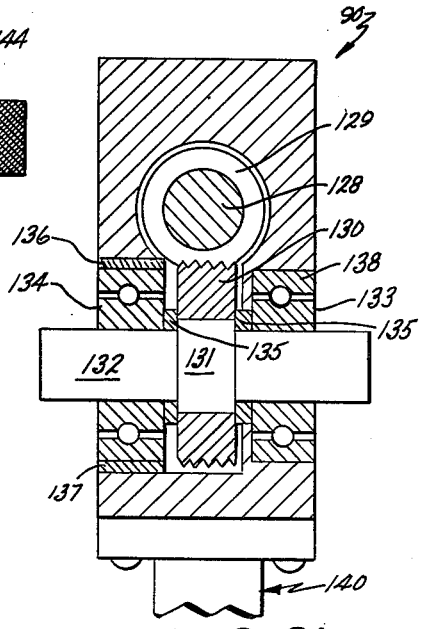
FIG. 21 is a sectional end elevation of the gear box and drive assembly taken along plane XXI—XXI of FIG. 20.

Referring now to FIGS. 3, 20 and 21, the spiral gear drive mechanism for rotating cranks 100 and 102 is shown. A rotating drive shaft 122 having a tapered end 123 leading from drill motor 120 is secured within a rotatable shaft 124 within a bore 125 which is parallel to support arm 12. Shaft 124 has a reduced diameter portion 125 received in a needle bearing 126 and abutting against a thrust bearing 127 at the front of the gear box. An intermediate diameter portion 128 of shaft 124 supports a helical gear 129 telescoped thereover and fixedly keyed to the shaft.

Helical gear 129 engages another helical gear 130 supported on a stepped portion 131 of shaft 132 and rotating at right angles to gear 129. Shaft 132 is rotatably supported by bearings 133, 134 spaced from step 131 by washers 135. Bearing 134 is fitted in a securing sleeve 136 received in a large bore 137 from one side of the gear box, which bore allows insertion of the helical gear 130 therethrough. The opposite side of the gear box includes a bore 138 sized to receive the bearing 133 alone. Accordingly, rotation of drive shaft 122 of drill motor 120 in turn rotates helical gears 129 and 130 to rotate shaft 132 and cranks 100 and 102 fixed on the opposite extending ends of that shaft.

In order to adjust the position of needle 30, cutting blade 70 and plunger 50 by hand without running drill motor 120, a hand crank mechanism 140 is secured to the bottom of the gear box 92. Hand crank 140 includes a tubular support 141 bolted to the bottom of the gear box and having an internal bore through which is received a shaft 142 rotatably supported in bearings 143, 144 at either end of the tubular support. A reduced diameter extending end of shaft 142 receives a third helical gear 145 which rotates at a right angle to gear 130 and engages a surface of helical gear 130 approximately one-quarter of the distance around the circumference of that gear from the point of contact of helical gear 129. The opposite end of shaft 142 is threaded and receives a large knob 146 enabling rotation of shaft 142 and helical gear 145. This rotates helical gear 130 and shaft 132 to change the position of cranks, 100, 102 and thus the needle, cutting blade and plunger. A recessed cutout 147 is provided in the front surface of the gear box in alignment with slide bars 52, 72 to receive the rear ends of those slide bars when the needle and cutting blade are in their retracted positions.

Figure 23:
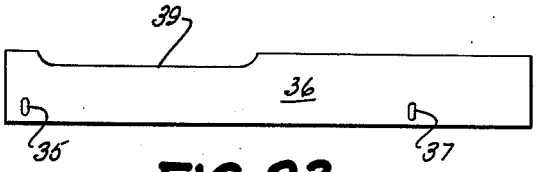
FIG. 23 is a side elevation of the needle slide guide bar for use in the needle advance mechanism.
Figure 22:
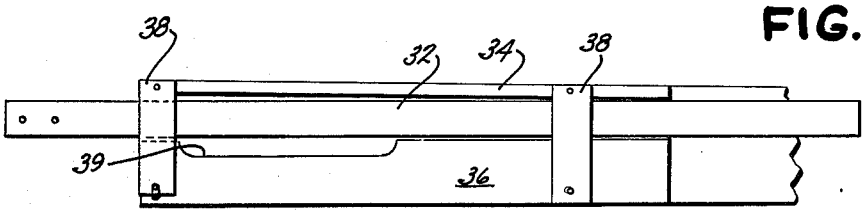
FIG. 22 is a fragmentary, side elevation of a portion of the support arm and needle slide assembly illustrating the needle advance mechanism.

As shown in FIGS. 22 and 23, guide bar 36, which slidingly supports needle slide bar 32, includes two spaced elongated holes 35, 37 therethrough. Holes 35, 37 are elongated in a direction transverse to the direction of elongation of the guide bar and generally transverse to the support arm 12 when mounted thereon. Guide bar 36 also includes a recess 39 providing access to the securing bolt of the cutting blade securing block 74 as shown in FIG. 1. As shown in FIG. 22, holes 35, 37 allow the pivotal movement of guide bar 36 in a direction transverse to the elongated extended direction of support arm 12 and transverse to the principal direction of reciprocation of the needle slide bar 32. This transverse movement is caused by the advancing pressure exerted on the machine by an operator with handle 22 and the handle of the drill motor 120 toward the needle 30 which is also in the direction of or toward recess 39. Such pressure forces slide bar 32 in the opposite direction causing guide bar 36 to pivot outwardly as shown in FIG. 22. Thus, as needle 30 is retracted and extension in the next tufting cycle is begun, crank arm 93 exerts an opposite force on slide bar 32 toward guide bar 34 which causes the needle secured to the end of slide bar 32 to advance to a fresh area of the backing material. This transverse motion during reciprocation of the needle is referred to as a warp and woof or walking movement facilitating advancement of the machine along the backing. Such advancement is also facilitated, as mentioned above, by insertion of tip 60 on needle 30 into a fresh area of the backing causing the sloped undersurfaces of the needle tip to cam the needle and the machine toward the fresh area of the backing.

Figure 28:
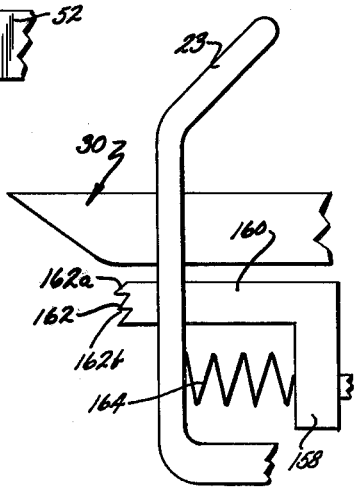
FIG. 28 is an enlarged, fragmentary side elevation of the needle and yarn-gripping member.
Figure 26:
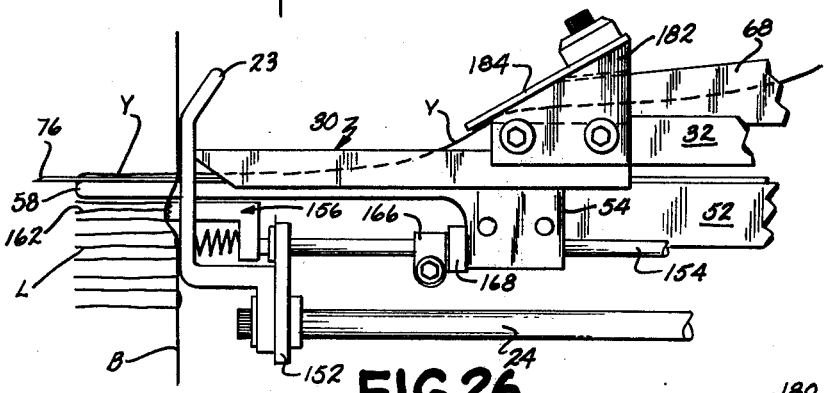
FIG. 26 is a fragmentary, side elevation similar to FIGS. 24 and 25 but illustrating a third stage in the loop-forming cycle wherein the cutting blade is projected through the backing material and beyond the plunger end to cut the formed loop.
Figure 27:
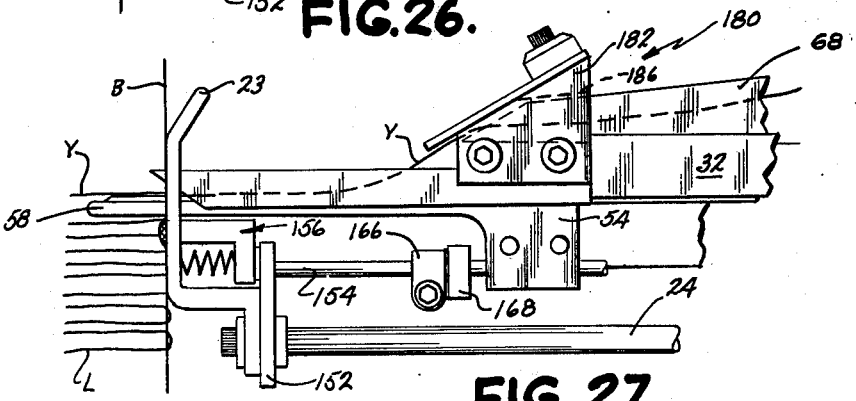
FIG. 27 is a fragmentary, side elevation similar to FIGS. 24-26 but illustrating a final stage in the loop-forming cycle when the cutting blade and plunger are being withdrawn and the needle is being inserted into the next adjacent portion of the backing material.

Referring now to FIGS. 1, 2, 4, 5 and 24–27, the yarn-holding mechanisms on either side of the needle 30 are shown. On the trailing or open side of the needle 30, the first yarn-holding mechanism 150 includes a support plate 152 clamped to the end of support rod 24 along with foot 23 by means of a screw and clamping washers. A slide rod 154 is slidably mounted through an aperture in support plate 152 and aperture 57 in flange 54 of plunger 50. A generally, L-shaped yarn-gripping member 156 has its shorter leg 158 secured to the end of slide rod 154. The other leg 160 of member 156 extends parallel to the needle 30 and plunger 50 and includes a plurality of elongated, yarn-gripping teeth 162 on the end surface thereof (see FIGS. 5, 24 and 28). A coil biasing spring 164 urges member 156 toward support arm 12 and against support plate 152 which forms a stop limiting movement of the member 156 away from the backing material. Member 156 is actuated for extension and positive gripping of the yarn forming the base of the previously formed loop as shown in FIG. 26 by engagement of a clamping stop collar 166 and a resilient washer 168, having metallic washers on either side thereof to prevent wear, by the front surface of flange 54 of plunger 50. Such actuation occurs against the force of the biasing spring 164 when the plunger is projected through the backing material as shown in FIG. 26. Stop collar 166 and resilient washer 168 are adjusted along the length of slide rod 154 such that member 156 is extended approximately 3/16 of an inch against the yarn and backing material slightly before the plunger reaches its greatest distance of extension and maintaining such extension during the greatest extension of the plunger and during cutting by the cutting blade 73. The leading surface 162*a* and of teeth 162 slope away from needle 30 to facilitate movement along the backing. The rear or back surfaces 162*b* of teeth 162 are perpendicular to yarn for secure holding of the yarn (see FIG. 28). In its retracted position, the gripping teeth 162 of gripping member 156 extend slightly past the contact surface of foot 23 to engage and exert pressure against the yarn and backing of the previously formed loop at all times. However, such pressure as well as the positive holding action is increased by extension of the member outwardly and against the backing and the previously formed yarn by engagement of the plunger with the stop collars as described above.

Yarn is held on the leading side of the needle 30 by yarn-holding mechanism 180 shown in FIGS. 1, 2, 4, 5 and 24–27. An upstanding, generally triangular channel member 182 having downwardly extending side flanges is secured to flange 45 of needle 30 with the side flanges engaging the side surfaces of that flange and bolts extending through one side flange of the channel 182 and apertures 45*b* of flange 45 which also enable securement of needle 30 to the slide bar 32 (see FIG. 5). A flexible, resilient spring steel plate 184 is secured to the sloped front side of channel member 182 by a clamping bolt 185 and plate at its upper end. The lower end of the plate 184 covers the rectangular opening of a passageway 186 extending generally longitudinally through channel member 182 for receipt of the tapered yarn guide 68 which extends into that passage as the needle 30 and yarn latch channel member 182 are retracted rearwardly toward the support arm 12. Upon its rearwardmost point of retraction, the front surface 69 of the yarn guide 68 engages the underside of spring plate 184 such that the yarn passing through guide 68, channel passage 186 and on into the needle 30 via passage 64 is clampingly held therebetween (see FIGS. 24–27).

The latching action between spring plate 184 and surface 69 of yarn guide 68 occurs when the needle 30 is at its point of greatest retraction toward support arm 12 which is also when cutting blade 73 is fully extended to cut the loop formed by the plunger 50. It is also at the same time that gripping member 156 is extended as shown in FIG. 26 whereby the yarn being formed and cut is held on both the leading and trailing or following sides of needle 30 to prevent further extension of the yarn by the cutting member or plunger to provide an even consistent pile across the entire carpet being tufted.

Referring now to FIGS. 24–27, the timed operation of the needle, cutting blade and plunger as operated by the spiral gear-driven crank arms, connecting arms and slide bars will be understood. At least one strand of continuous yarn is fed through yarn guide tube 19, yarn aperture 89*b*, yarn guide 68, passageway 186 in yarn latch 180 into opening 64 in needle 30 and through the internal yarn passageway 66 of the needle. The yarn then passes around the gripping teeth 162 of gripping member 156 leading to the previously formed loop or cut pile L in the woven backing or fabric as shown in FIGS. 24–27.

The operational cycle begins with the needle 30 slightly extended such that tip 60 is projected through the backing B with the bottom of foot 23 engaging the surface of the backing opposite the side from which the needle is projecting. Operation of the drill motor 120 rotates gear shaft 132 rotating crank 100 in a clockwise direction sliding slide bar 32 and needle 30 rearwardly and out of the backing by means of the pivotal connecting arm 93. Needle 30 is slid rearwardly at this point because it has already formed an opening through which the yarn may be projected and is being retracted in preparation for insertion in a fresh area of the backing as described below.

During sliding retraction of the needle 30, crank 102 is simultaneously being rotated by shaft 132 on the opposite side of the gear housing to slide plunger slide bar 52 and plunger 50 forwardly such that rounded, recessed plunger end 58 engages the yarn strand or strands extending across the opening between member 156 and the needle and pushes the yarn through the opening formed by the needle. Such pushing action pulls yarn through the yarn guide tubes, yarn latch and needle which provide a free, unrestricted path for the yarn (see FIG. 25). At the same time, rotation of crank 102 also urges slide bar 72 forwardly such that the cutting edge 76 is advancing behind the leading edge 58 of the plunger.

As the plunger 50 continues to extend through the backing, it reaches its great distance of extension as shown in FIG. 26. Slightly before reaching that greatest extension, the front edge of flange 54 engages resilient washer 166 urging slide rod 154 and gripping member 156 outwardly against the backing to firmly and positively grip the base of the previously formed yarn loop which also holds one extending strand of the loop being formed. Simultaneously, the needle 30 reaches its greatest point of retraction such that leading edge 69 of yarn guide 68 engages the underside of spring plate 184 thereby positively gripping and latching the strand of yarn between that edge 69 and the plate 184 to prevent further extension of the yarn. During the holding periods of member 156 and yarn latch 180, cutting blade 73 has been extended past the greatest distance of extension of plunger end 58 such that the strand or strands of yarn are received in the sharpened V notch 76. Since the yarn is held from further extension from both sides of the needle and plunger, further extension of the cutting blade severs the strands cleanly and neatly without further extending the yarn.

Immediately thereafter, plunger 50 and cutting blade 73 are retracted while needle 30 is being advanced through a fresh area of the backing to provide an opening through which the plunger and cutting blade will again be inserted to form the next loop or cut pile. Since cutting blade 70 is connected to shaft 132 by means of an extra connecting link or clamping member 118 than is plunger 50, connecting pin 121 travels through a greater distance in the same rotational speed thereby retracting cutting blade 70 at a faster rate than plunger 50. Retraction of the plunger also retracts gripping member 156 while extension of needle 30 releases the yarn at yarn latch 180 to enable the plunger to pull another length of yarn through the latch on its next cycle.

As above, the timing of the extension and retraction of the needle, cutting blade and plunger is governed by the positions at which the connecting arms are connected to the cranks 100 and 102 as well as the positions of the cranks 100 and 102 with respect to each other. Further, the timing between the cutting blade and plunger is governed by the rotational position of the clamping member 118 on post 113.

The cutting blade can be simply and easily adjusted such that it never extends beyond the end of plunger 58 and thus never severs the yarn formed into loops. Such adjustment can be made by shortening the length of arm 108, rotating connecting member 118 rearwardly with respect to arm 103, or fastening cutting blade 70 to a portion of slide 72 spaced further back from the end.

Accordingly, the present invention provides a balanced, hand-operated, power tufting machine which is easily operated and guided through the most intricate patterns to produce tufted carpeting. The machine may be easily adjusted to form loop or cut pile while the height of the loop or cut pile being formed may be simply adjusted by changing the position of pivot post 113 along the length of slot 115 in crank 102 without changing the timing between the needle, cutting blade and plunger. The machine operates smoothly and evenly with a minimum of vibration and at a speed in excess of those obtainable with prior known machines.

While several forms of the invention have been shown and described, other forms will now be apparent to those skilled in the art. Therefore, it will be understood that the embodiments shown in the drawings and described above are merey for illustrative purposes and are not intended to limit the scope of the invention which is defined by the claims which follow.

The embodiments of the invention in which an exclusive property or privilege is claimed are defined as follows:

1. A tufting machine for forming loop or cut pile fabrics comprising an elongated, rigid support arm having two ends; means on said support arm for engaging a backing material; forming means at one end of said arm for forming successive loop or cut pile tufts from a continuous length of yarn in the backing material, said forming means including a needle for insertion through a backing, a plunger having a rounded end for pushing at least one loop of yarn through the backing to a predetermined distance beyond the backing at the point of insertion of said needle, and a cutting blade for cutting the loop of yarn; said needle being channel like, hollow and open on one side and receiving said cutting blade and plunger longitudinally and slidably therewithin such that said needle, cutting blade and plunger are aligned and parallel to one another, said cutting blade being intermediate said plunger and the closed side of said needle; slide means mounted on the exterior of said support arm for individually and separately reciprocating said needle, cutting blade and plunger; and drive means at the other end of said support arm for reciprocally moving said slide means in timed relationship to one another.

2. The tufting machine of claim 1 including yarn-holding means on both the leading and trailing sides of said forming means for positively holding the yarn during formation of the loop of yarn and any cutting of the yarn loop.

3. The tufting machine of claim 2 including a yarn-gripping member on the trailing side of said forming means for holding the base of the yarn loop previously formed by said machine during formation of the next loop and extension means for extending said gripping member during the time said plunger is extended through said backing its greatest distance and during any cutting of the yarn loop by said cutting blade.

4. The tufting machine of claim 3 wherein said plunger includes actuating means for extending said yarn gripping member when said plunger is fully extended through the backing material.

5. The tufting machine of claim 3 wherein said gripping member includes gripping teeth on the surface thereof which engages said yarn.

6. The tufting machine of claim 3 including a yarn latch on the leading side of said needle for gripping and holding the yarn during the time said plunger is extended through said backing its greatest distance and during any cutting of the yarn loop with said cutting blade.

7. The tufting machine of claim 6 wherein said yarn latch is mounted on and movable with said needle and includes a flexible, resilient, yarn-engaging member for pressing a portion of the continuous length of yarn near said point of insertion through the backing material against a fixed yarn support to hold said yarn from further extension and allow formation of the yarn loop to a precise height.

8. The tufting machine of claim 2 including a yarn latch on the leading side of said needle for gripping and holding the yarn during the time said plunger is extended through said backing its greatest distance and during any cutting of the yarn loop with said cutting blade.

9. The tufting machine of claim 7 wherein said yarn latch is mounted on and movable with said needle and includes a flexible, resilient yarn-engaging member for pressing a portion of the continuous length of yarn near said point of insertion through the backing material against a fixed yarn support to hold said yarn from further extension and allow formation of the yarn loop to a precise height.

10. The tufting machine of claim 1 wherein said support arm is a solid bar having a rectangular cross-section, said slide means being slidably fitted to the exterior side surfaces of said arm.

11. The tufting machine of claim 10 including elongated recesses in said exterior sides of said arm for receiving said slide means.

12. The tufting machine of claim 10 including elongated, rigid guides for supporting said slide means, said guides being secured to said exterior sides of said arm.

13. The tufting machine of claim 1 wherein said slide means include a plurality of elongated, rigid slide bars fitted for sliding reciprocation on opposing exterior surfaces of said arm; one slide bar supporting and rigidly secured to each of said needle, cutting blade, and plunger; said drive means including crank means for individually reciprocating each of said slide bars.

14. The tufting machine of claim 13 wherein said drive means include a gear housing, a plurality of gears, and an electric motor connected thereto for continuously rotating a drive shaft extending through said gear housing; said crank means including a crank arm fixedly secured to each end of said shaft on opposite sides of said housing and at least one connecting arm pivotally secured between each of said slide bars and one of said crank arms.

15. The tufting machine of claim 14 wherein said needle is fixedly secured to one end of a first one of said slide bars which is on one side of said support arm; said cutting blade being fixedly secured to a second one of said slide bars which is on the opposite side of said support arm from said first slide bar; said plunger being fixedly secured to a third one of said slide bars which is mounted immediately below and slidably engaged with said second slide bar on said opposite side of said support arm; each of said slide bars being connected to the crank arm on its respective side of said support arm and gear housing by at least one of the said connecting arms.

16. The tufting machine of claim 15 wherein said connecting arm for said plunger is pivotally connected to a fixed shaft projecting from said crank arm adjacent said opposite side of said support arm and parallel to said drive shaft; said fixed shaft having a link fixedly secured thereto and parallel to said crank arm, said link being pivotally secured to said connecting arm for said cutting blade whereby said cutting blade is reciprocated in timed relationship to said plunger.

17. The tufting machine of claim 16 including means for securing said fixed shaft at various positions along the length of said crank arm adjacent said opposite side of said support arm whereby the distance of insertion of said plunger and cutting blade are simultaneously adjustable while maintaining the same timed, reciprocating relationship between said plunger and cutting blade.

18. The tufting machine of claim 14 wherein at least said connecting arms for reciprocating said needle and cutting blade each include means for adjusting the length of said respective connecting arms whereby the distance said needle and cutting blade are inserted through the fabric backing may be adjusted.

19. The tufting machine of claim 14 including another gear engaging one of said gears in said gear housing and a hand-operable rotatable shaft extending from said gear housing and connected to said other gear whereby the positions of said needle, cutting blade and plunger and said slide bars and connecting arms therefor are adjustable by hand with said rotatable shaft and other gear.

20. The tufting machine of claim 13 including an elongated support bar having an edge slidably engaging the slide bar for said needle on the edge of said needle slide bar closest to said open side of said needle, said cutting blade and plunger; said elongated support including spaced, elongated holes therethrough having their directions of elongation generally transverse to the direction of elongation of said needle slide bar and said elongated support; said elongated support being secured to said support arm with retaining plates over the exposed side of said elongated support with a fastener extending through each of said elongated holes such that said elongated support and said needle slide bar are movable in the direction of elongation of said holes whereby said needle is allowed to move transverse to the direction of elongation of said support arm to facilitate advancement of said needle and tufting machine along the backing material.

21. The tufting machine of claim 1 wherein said slide means for said needle provide reciprocating movement of said needle in the direction of elongation of said support arm; said slide means also including means for allowing movement of said needle in a direction transverse to the direction of elongation of said support arm to facilitate advancement of said needle and tufting machine along the fabric backing.

22. The tufting machine of claim 1 wherein said needle includes a backing material penetrating portion and means for rigidly securing said needle to said slide means; said penetrating portion having a pointed penetrating tip and sloped surfaces over the closed side of said needle, said sloped surfaces merging with parallel flanges which slope toward said tip and form the channel-like body of said penetrating portion; said sloped surfaces forming a rectilinear ridge along the closed side of said penetrating portion, the distance from said ridge to the bottoms of said side channels facilitating advancement of said needle and tufting machine along the backing material.

23. The tufting machine of claim 22 wherein said needle includes a channel-like yarn entrance opening through said closed side of said needle, said entrance opening having raised sides therearound and a sloped surface within said raised sides and leading to said opening for guiding passage of the yarn into the needle.

24. The tufting machine of claim 22 wherein said cutting blade is an elongated, thin, flexible, resilient cutting blade having a width sufficient to allow receipt within said needle, a sharp-edged V notch in its outer end for cutting yarn loops formed by said plunger, and means at its other end for rigidly securing said blade to said slide means, said needle including an internal, rectilinear surface for slidably engaging and guiding said cutting blade during reciprocation.

25. The tufting machine of claim 24 wherein said plunger includes an elongated bar having means at one end for rigidly securing the plunger to said slide means, a rounded, recessed end opposite said end with said securing means, and a width sufficient to allow receipt within said needle and against said cutting blade whereby said cutting blade is slidably sandwiched between said rectilinear, internal needle surface and said plunger.

26. The tufting machine of claim 25 wherein said plunger includes abrasive means on its surface which slidingly engages said cutting blade for lapping against said cutting blade whereby said sharp-edged end of said cutting blade is continuously sharpened during reciprocation by lapping against said abrasive means.

27. The tufting machine of claim 1 wherein said cutting blade has a sharp-edged end for cutting the yarn loops, said cutting blade being slidably sandwiched between a surface within said channel-like needle and said plunger; said plunger surface which engages said blade having abrasive means for continuously lapping against and sharpening said cutting blade end during operation of said machine.

28. The tufting machine of claim 1 including a support ring extending transversely around said machine; means for securing said ring to said machine; and a swivel handle secured to said support arm intermediate said support ring and said forming means.

29. The tufting machine of claim 28 wherein said machine is balanced, said support ring lying in a plane passing through the center of gravity of said machine.

30. The tufting machine of claim 1 inlcuding backing material engaging means adjacent said forming means for supporting said machine against a backing material.

31. A tufting macnine for forming loop or cut pile fabrics comprising an elongated, rigid support arm; slide means on said support arm for individually slidably supporting and reciprocating a hollow, channel-like needle having a channel opening along one side, a cutting blade and a plunger at one end of said support arm, said plunger and cutting blade being nested within said channel opening of said needle with said cutting blade intermediate said plunger and needle and slidably engaged and supported thereby, said needle adapted to form successive openings through a backing material, said plunger adapted to push a loop of yarn of predetermined length through each of said openings, and said cutting blade adapted to cut said loops into cut pile tufts as desired; drive means for reciprocating said slide means, and thus, said needle, cutting blade and plunger in timed relationship with respect to one another; yarn guide means for guiding a continuous strand of yarn to said needle, cutting blade and plunger; first extendible yarn-holding means for positively holding the yarn against the backing material on one side of said needle during formation of the loops by said plunger; and second yarn-holding means for clamping and holding the yarn on the opposite side of said needle during any cutting of the formed loops by said cutting blade whereby formation and any cutting of the yarn loops is precisely controlled to produce a tufted fabric with cut or loop pile of precisely even height.

32. The tufting machine of claim 31 including a support foot secured to and projecting from said support arm adjacent said needle, cutting blade and plunger for supporting said machine against the backing material; said first yarn-holding means including a yarn-gripping member and extension means for extending said gripping member against the yarn at the base of the loop previously formed during the greatest extension of said plunger through the backing.

33. The tufting machine of claim 32 wherein said plunger includes actuating means for engaging and extending said extension means.

34. The tufting machine of claim 33 wherein said extension means includes a rigid rod slidably mounted on said support foot parallel to said plunger; said yarn-gripping member being secured to the outer end of said rod; biasing means for biasing said gripping member and rod toward said support arm and to an unextended position; a stop for limiting movement of said gripping member toward said support arm; said actuating means including a flange on said plunger; and means on said rod for engaging said plunger flange for sliding said rod and gripping member against said biasing means to an extended position.

35. The tufting machine of claim 34 wherein said gripping member includes a plurality of elongated, yarn-gripping teeth on its surface which engages said yarn.

36. The tufting machine of claim 31 wherein said second yarn-holding means includes a yarn latch mounted on and reciprocal with said needle, said latch including a flexible, resilient spring plate for clamping said yarn when said needle is withdrawn from the backing material and said plunger is fully extended to prevent further extension of said yarn during cutting.

37. The tufting machine of claim 31 wherein said second yarn-holding means includes an elongated yarn guide mounted on said support arm and having a yarn-guiding aperture therethrough, a channel member mounted on said needle and reciprocal therewith, said channel member having a yarn-guiding channel therethrough of sufficient width to receive said yarn guide therein, and a flexible, resilient spring plate secured to said channel member; said yarn being clamped between said spring plate and a portion of said yarn guide when said needle is withdrawn from the backing material and said plunger is fully extended to prevent further extension of said yarn during cutting.

38. The tufting machine of claim 31 wherein said needle includes a channel-like yarn opening in its otherwise closed side through which yarn is admitted within said needle, said yarn opening having raised sides therearound and a sloped surface within said raised sides leading to the said opening for guiding the passage of yarn from said second yarn holding means and into said needle, said yarn then passing around said plunger and past said first yarn-holding means.

39. The tufting machine of claim 31 wherein said slide means for said needle provide reciprocating movement of said needle in the direction of elongation of said support arm; said slide means also including means for allowing slight movement of said needle in a direction transverse to the direction of elongation of said support arm to facilitate advancement of said needle and tufting macine along the backing material.

40. The tufting machine of claim 31 wherein said support arm is a solid bar having a rectangular cross-section, said slide means being slidably fitted to the exterior side surfaces of said arm.

41. A tufting machine for forming loop or cut pile fabrics comprising an elongated, rigid support arm; loop forming means on said support arm for forming successive loops in a backing material from at least one continuous strand of yarn; said loop forming means including a needle rigidly mounted on a first reciprocable slide for making yarn insertion openings through the backing material and a plunger having a rounded tip rigidly mounted on a second reciprocable slide for pushing yarn through said openings to form yarn loops; said support arm having a rectangular cross-sectional shape transverse to its direction of elongation; means for mounting said slide bars for reciprocation along exterior surfaces of said support arm; drive means for reciprocating said slide bars, and thus, said needle and plunger with respect to one another and said support arm whereby said slide bars are easily accessible for maintenance and are highly wear-resistant; a third slide bar slidably mounted on said support arm and having one edge slidably engaged with said second slide bar; said said and third slide bars being mounted on one side of said support arm; said first slide bar being mounted on a side of said support arm opposite said one side; a cutting blade rigidly secured to said third slide bar and slidably mounted and supported between said needle and plunger.

42. The tufting machine of claim 41 including yarn-holding means on both the front and rear sides of said loop-forming means for positively holding the yarn during formation of the loop of yarn and any cutting of the yarn loop.

* * * * *

UNITED STATES PATENT AND TRADEMARK OFFICE

CERTIFICATE OF CORRECTION

PATENT NO. : 4,132,182

DATED : January 2, 1979

INVENTOR(S) : Theodore C. Heemstra

It is certified that error appears in the above-identified patent and that said Letters Patent are hereby corrected as shown below:

Column 1, line 13

"machies" should be -- machines --

Column 1, line 16

"operating" should be -- opening --

Column 5, line 20

"28" should be -- 27 --

Column 9, line 3

"connection" should be -- connecting --

Column 13, line 21

"merey" should be -- merely --

Column 16, Claim 30, line 49

"inlcuding" should be -- including --

UNITED STATES PATENT AND TRADEMARK OFFICE

CERTIFICATE OF CORRECTION

PATENT NO. : 4,132,182

DATED : January 2, 1979

INVENTOR(S) : Theodore C. Heemstra

It is certified that error appears in the above-identified patent and that said Letters Patent are hereby corrected as shown below:

Column 16, line 52, claim 31

"macnine" should be -- machine --

Column 18, line 45, claim 41

"said" should be -- second --

Signed and Sealed this

*Third* Day of *July 1979*

[SEAL]

*Attest:*

*Attesting Officer*

LUTRELLE F. PARKER

*Acting Commissioner of Patents and Trademarks*